US005817969A

United States Patent [19]

Ettmüller

[11] Patent Number: 5,817,969

[45] Date of Patent: Oct. 6, 1998

[54] SPIN-STABILIZED PROJECTILE WITH PAYLOAD

[75] Inventor: Peter Ettmüller, Adlikon, Switzerland

[73] Assignee: Oerlikon Contraves Pyrotec AG, Zurich, Switzerland

[21] Appl. No.: 647,324

[22] Filed: May 9, 1996

Related U.S. Application Data

[63] Continuation-in-part of Ser. No. 513,561, Aug. 10, 1995, abandoned.

[30] Foreign Application Priority Data

Aug. 26, 1994 [CH] Switzerland ..... 02 614/94

[51] Int. Cl.[6] ..... F42B 12/60

[52] U.S. Cl. ..... 102/489; 102/357; 102/393; 102/494

[58] Field of Search ..... 102/340, 342, 102/351, 357, 378, 389, 393, 473, 478, 479, 489, 491–497, 505, 506, 517–519, 703

[56] References Cited

U.S. PATENT DOCUMENTS

| | | | |
|---|---|---|---|
| 603,525 | 5/1898 | Darmancier | 102/494 |
| 631,703 | 8/1899 | Dunn . | |
| 3,013,490 | 12/1961 | Flatau | 102/393 |
| 3,093,072 | 6/1963 | Pigman | 102/489 |
| 3,108,540 | 10/1963 | Fletcher | 102/378 |
| 3,374,740 | 3/1968 | Voda | 102/489 |
| 3,954,060 | 5/1976 | Haag et al. . | |
| 3,981,242 | 9/1976 | Shurtleff | 102/494 |
| 4,036,141 | 7/1977 | Korr et al. | 102/489 |
| 4,335,655 | 6/1982 | Lofgren | 102/505 |
| 4,488,489 | 12/1984 | Schoffl | 102/489 |
| 4,724,769 | 2/1988 | Luther et al. | 102/518 |
| 4,770,101 | 9/1988 | Robertson et al. | 102/489 |
| 4,986,188 | 1/1991 | Denis et al. . | |

FOREIGN PATENT DOCUMENTS

| | | |
|---|---|---|
| 0357514 | 3/1990 | European Pat. Off. . |
| 2075264 | 10/1971 | France . |
| 42925 | 7/1887 | Germany . |
| 119324 | 8/1899 | Germany . |
| 2638920 | 3/1978 | Germany . |
| 3326877 | 2/1985 | Germany . |
| 8436168 | 6/1985 | Germany . |
| 1298652 | 12/1972 | United Kingdom . |

OTHER PUBLICATIONS

Skyguard Fire Control/35mm Twin Gun Air Defence System Demonstrations, Sep. 21/22, 1993, Oerlikon–Contraves.

"The Lethal Blow to Any Missile or Other Airborne Threat," OC 2050 e 93.

"Skyguard Fire Control . . . Sep. 21/22, 1993," OC 2052 e 94.

"Skyshields 35 The Ahead Air Defense System . . . ," OC 2063 e 9504.

*Primary Examiner*—Harold J. Tudor

*Attorney, Agent, or Firm*—Greenblum & Bernstein, P.L.C.

[57] ABSTRACT

A spin-stabilized projectile containing a payload is presented. The projectile includes a projectile body with a payload chamber that may be laterally defined by a projectile casing, on top by an axial fixing device for a payload disposed in the payload chamber, and on the bottom, by a dividing wall. The projectile casing may include axial grooves on the inside, which on the contribute to the fixing of the payload and include intended break zones for freeing the payload. Below the dividing wall, an opening charge may be disposed, which includes complete radial contact and is axially spaced apart from the dividing wall by a damping device. The detonation of opening charge causes the projectile casing to immediately split open at the intended break zones to release, by centrifugal force, the payload from the payload chamber. The damping device prevents the payload from being damaged in the region of the dividing wall and prevents the release of the payload from being interrupted.

1 Claim, 3 Drawing Sheets

FIG. 5A FIG. 5B FIG. 5C FIG. 5D FIG. 5E
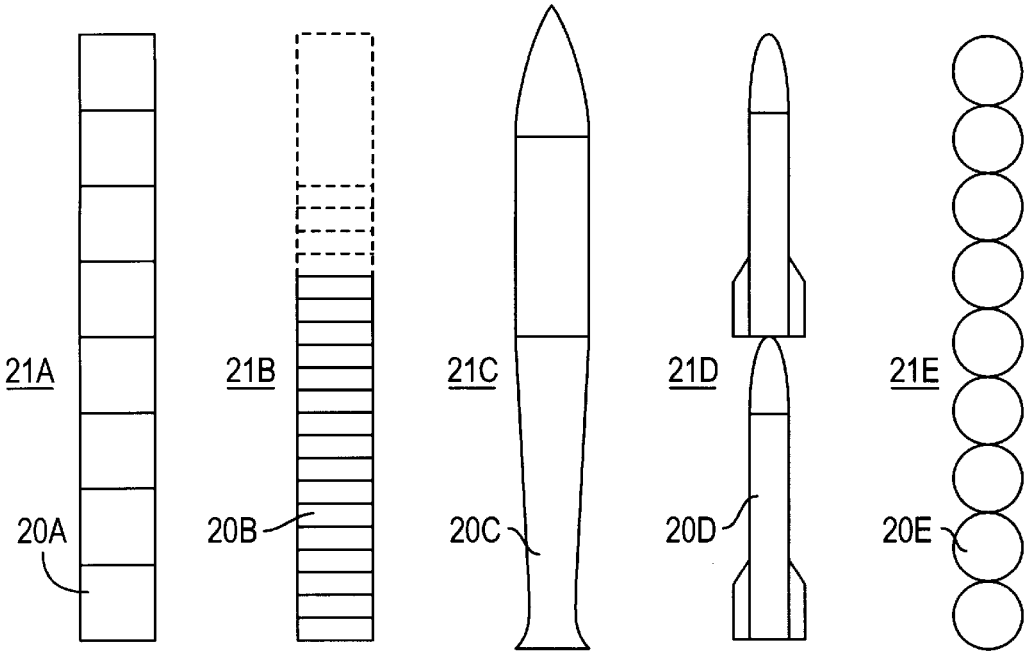
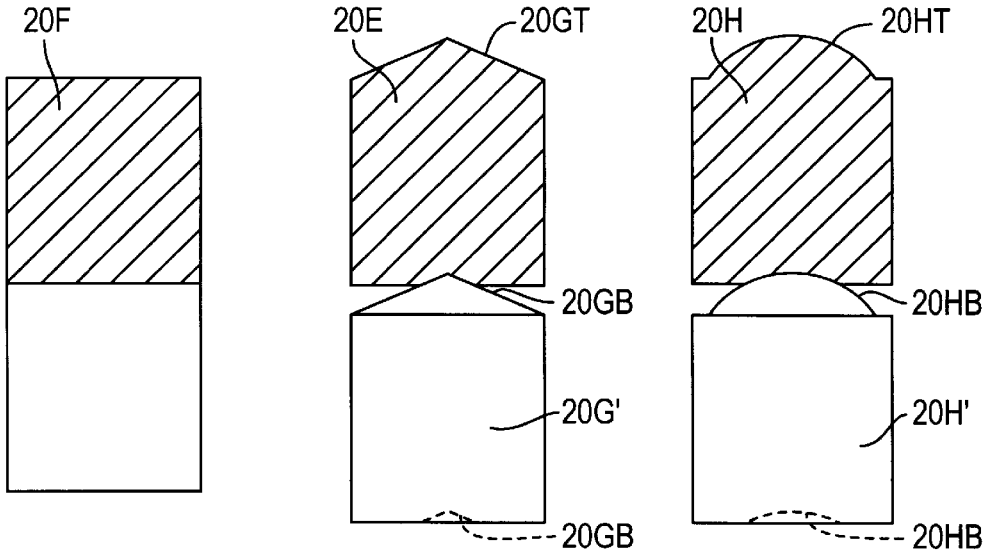
FIG. 6A FIG. 6B FIG. 6C

SPIN-STABILIZED PROJECTILE WITH PAYLOAD

CROSS-REFERENCE TO RELATED APPLICATION

The present application is a continuation-in-part of U.S. application Ser. No. 08/513,561 filed on Aug. 10, 1995, now abandoned and claims the priority of Swiss Application No. 02 614/94-3, filed Aug. 26, 1994, the disclosure of U.S. application Ser. No. 08/513,561 being expressly, incorporated herein by reference in its entireties.

BACKGROUND OF THE INVENTION

1. Field of the Invention

The invention relates to a spin-stabilized projectile which contains a releasable payload. Within the scope of the invention, the term "payload" may be understood as a quantity of transport material contained in a payload chamber.

Projectiles of this type may transport various payloads for various purposes, e.g., military purposes or civil purposes. Meteorology is one example of a civil purposes. These projectiles may also be implemented for various uses, i.e. surface to surface, surface to air, air to surface, and air to air.

Given equal overall volume and weight, a projectile becomes more efficient as payload increases. Therefore, it is desirable to take as much advantage of the available space in the payload chamber, i.e. housing the payload as densely as possible in the payload chamber. The optimum utilization of available space may be achieved when the payload completely fills the payload chamber, i.e., the cross section of the payload is equal to the cross-section of the payload chamber. The payload may be divided into columns, in which case the best use of space may be achieved when the columns are configured to spatially fill as large an area as possible with the payload.

This could be achieved with columns including cross sections of, for example, rectangular, square, triangular, or regularly hexagonal shape. However, in addition to the cross-section of the column, other demands may need to be met, for example, cost, ease of manufacture and assembly, control of flight by spin-stabilization, etc. In general, columns with round cross-sections may be used, and may include projections for an arrow stabilization. Round cross-sections are superior to the other above-mentioned designs, except with respect to maximizing use of space or packing density.

2. Discussion of the Background of the Invention

Conventionally, the payload is released as the outer shell is exploded by the ignition of an explosive charge and/or the sub-projectiles were ejected from the outer shell by the ignition of an ejection charge. A considerable quantity of explosive was required for both the explosive charge and the ejection charge. Accordingly, a relatively large quantity of explosive had to be built into the projectile, which undesirably restricts the payload.

In order to get by with as small as possible a quantity of explosive and as a result, to be able to provide as large as possible a payload, explosive charges for exploding the projectile casing, or ejection charge for ejecting the payload, were replaced with an opening charge. These charges may be considerably smaller than the explosive charge or ejection charge. In principle, the opening charge is used only for producing lateral openings in the projectile casing along a plurality of casing lines, whereupon the parts of the projectile casing released are removed in a tangential direction relative to the rest of the projectile. The payload which is no longer contained by the outer shell is released as a result. The discharge of the payload happens as follows: before its destruction, the projectile casing exerts a centripetal force on the payload, which as a result of the spin of the projectile, rotates around the longitudinal axis of the projectile. This centripetal force ceases with the destruction of the projectile casing because of the production of the openings in it by the opening charge so that with the action of centrifugal force, the payload leaves its original location and departs in the tangential direction from the projectile or from the rest of the projectile. The tangential component of the payload velocity thus produced is added to the axial component of the payload velocity, which is the same in magnitude and direction as the flight velocity of the projectile. If the payload is divided into coaxial columns, then each column continues to fly at a certain angle of departure relative to the flight path of the projectile, wherein the flight paths of the columns constitute the generatrix of a cone, whose axis is the flight path of the projectile and whose apex is the location of the payload release.

The above described kind of payload release takes place successfully only if the projectile spin is completely transmitted to the columns of the payload before the opening of the projectile casing. Then the payload may be driven in rotation around the longitudinal projectile axis at a resulting tangential velocity component when the columns are released.

At the same time as the rotation around the projectile axis, the payload rotates around itself, i.e., an individual rotation, which may be described as spin. Thus, both before and after release, the payload rotates around its own axis. The advantageous function of this individual rotation or spin is described in more detail below.

So that the spin of the projectile is transmitted to the payload, the above-mentioned tangential component of velocity, which causes the payload to leave the payload chamber, is produced. The payload must be fixed in the payload chamber so that it does not rotate relative to the projectile casing. To that end, U.S. Pat. No. 603,525 discloses that the payload is divided into coaxial columns and that the payload chamber is recessed on the inside so that it has grooves which extend axially. The grooves are approximately the shape of a half-cylinder, whose diameter is the same as that of the columns and in which the columns are disposed.

In order to open the projectile casing as intended in zones along casing lines and in order to keep the quantity of the required explosive as low as possible, known projectiles include a projectile casing that is recessed so that a plurality of intended break zones, running at least approximately axially and evenly distributed over the circumference, open for deploying the columns as a result of the action of the ignited explosive.

As discussed in U.S. Pat. No. 603,525, the intended break zones, although not expressly described as such, are produced by the grooves with the approximately half-cylindrical shape used to tangentially fix the layer of columns resting against the projectile casing, i.e. the outermost layer, relative to the projectile. These grooves extend axially along the inner wall of the sub-projectile chamber and result in the fact that the projectile casing has changing wall thicknesses in the circumferential direction. The intended break zones naturally coincide with the regions of the lowest wall thickness. The intended break zones are more efficient the more abruptly the wall thickness changes.

For the further use of the payload, it is of the utmost significance that the payload not be damaged in the detonation of the opening charge in the explosive chamber. For example, U.S. Pat. No. 603,525 produces a pressure wave in the explosion of the opening charge which naturally acts upon the comparatively weak base plate. Accordingly, it is not certain that detonation of the opening charge is used exclusively for breaking open the projectile casing. Consequently, there is the danger of damaging the payload prior to release.

SUMMARY OF THE INVENTION

Accordingly, it is an object of the present invention to produce a spin-stabilized projectile with payload which does not suffer the disadvantages of the prior art devices of damaging payload prior to and during release. The forces produced as a result of detonating the opening charge, therefore, are not permitted to act upon the payload via a dividing wall. However, the surroundings of the explosive chamber may be structurally configured to produce a power flux only for the purpose of opening of the projectile.

Accordingly, the present invention is directed to a spin-stabilized projectile for delivering a payload that includes an elongated casing having a longitudinal axis. The longitudinal axis extending from a top portion of the elongated casing to a bottom portion of the elongated casing. The projectile also includes a payload chamber disposed within the elongated casing having a chamber top and a chamber bottom, a dividing wall disposed between the bottom portion of the elongated casing and the chamber bottom, an opening charge positioned within a recess formed in the dividing wall and coupled to a detonation device for detonating the opening charge, the dividing wall transmitting a radial force generated by a detonation of the opening charge, and a suppression space for suppressing axial force generated by the detonation of the opening charge, the suppression space positioned between the opening charge and the recess.

In accordance with one feature of the present invention, the payload chamber may include an inner surface substantially parallel to the longitudinal axis and having a plurality of arcuate grooves. The arcuate grooves for fixing the payload against radial and tangential movement. Additionally, the arcuate grooves for forming intended breaking zones in the elongated casing substantially parallel to the longitudinal axis.

According to another feature of the present invention, the payload may include a plurality of elongated sub-projectiles arranged parallel to the longitudinal axis, the plurality of sub-projectiles positioned within the payload chamber to restrict radial and tangential movement. The elongated sub-projectiles may include a plurality of coaxially aligned sub-projectiles. Each of the plurality of coaxially aligned sub-projectiles may include a conical top portion and a conical bottom recess for receiving a conical top portion of another of the plurality of coaxially aligned sub-projectiles. Alternatively, the plurality of elongated sub-projectiles may include a partially arrow stabilized sub-projectile and the plurality of coaxially aligned sub-projectiles may include partially arrow stabilized sub-projectiles.

According to a further feature of the present invention, each of the plurality of coaxially aligned sub-projectiles may include a spherical top portion and a spherical bottom recess for receiving a conical top portion of another of the plurality of coaxially aligned sub-projectiles.

According to another feature of the present invention, the suppression space may include an air gap. Alternatively, the suppression space being filled with a damping material.

According to yet another feature of the present invention, the projectile further includes an axial fixing device for retaining the payload within the payload chamber, the axial fixing device positioned between the top portion of the elongated casing and the chamber top and including a screw member.

According to yet another feature of the present invention, a wall thickness of the elongated casing decreases along the longitudinal axis from the bottom portion to the top portion.

According to still another feature of the present invention, a curvature of the arcuate grooves is smaller than a curvature of a cross section of a cylindrical column of the payload. The payload may include a plurality of cylindrical columns positioned so that a generating curve of their envelope forms a polygon, the polygon having a number of sides equal to a number of arcuate grooves, the arcuate grooves provided in a number of groups equal to one-half of the number of arcuate grooves with angular intervals of 360°/number of groups. A mutual spacing of groups is greater than a spacing of arcuate grooves within the group.

According to still another feature of the present invention, the axial fixing device being screwed to the elongated casing for adjusting an axial length of the payload chamber.

According to another feature of the present invention, the projectile further may include a penetrator device disposed on top of the payload chamber.

The projectile according to the present invention includes a dividing wall that is stable, that is integrally formed on the projectile casing or firmly connected to the projectile casing, and that the forces produced in the detonation of the opening charge, as a result of an axial damping device, act immediately upon the projectile casing. These features result in opening the projectile casing without damaging the payload. As an additional advantage, no explosive is unnecessarily spent. Thus, the smallest possible quantity of explosive may be required and the largest possible payload may be accommodated.

In a simple and very effective embodiment, the damping device may be realized by an air-filled gap in which the explosive charge may be spaced apart from the dividing wall, while in the radial direction, the explosive charge abuts the wall of the explosive chamber. Alternatively, the gap may naturally also be filled by a damping substance.

To ensure that the projectile casing actually splits open as intended at the axially extending intended break zones, the projectile wall thickness may be dimensioned so that it decreases in the axial direction from the bottom to the top. As a result, the splitting open is not stopped at a wall reinforcement. In general, projectile casings with constant wall thickness may be chosen because they are easier to manufacture and achieve satisfactory results. However, projectile casings with wall thicknesses which increase toward the front are functionally disadvantageous and are therefore to be avoided.

The payload can be embodied by a single column; in most cases, though, it is divided into a plurality of coaxial columns disposed next to one another.

So that the payload is dispersed in the intended manner, i.e., laterally from the flight path of the projectile, the payload, prior to release, must exhibit rotational motion around a longitudinal projectile axis or it must rotate together with the projectile. Accordingly, the payload may be fastened in the projectile so that it rotates together with the projectile or carries out a rotational motion relative to the projectile. In the projectile described in U.S. Pat. No. 603,525, the payload, which is divided into columns, is in fact fixed so that the columns which rest against the projectile casing engage with approximately half of their circumference in grooves with practically semicircular profiles. This device, however, has the disadvantage that the columns of the payload must be exactly sized in a relatively precise manner so that the only processes considered for their manufacture are the ones with which the required precision can be achieved. These kinds of processes are generally very expensive, Thus, reasonably priced processes, in particular in the region of non-cutting manufacturing, are left out of consideration. In order to avoid this disadvantage, in a preferred exemplary embodiment of the projectile according to the invention, the curvatures of the groove profiles are chosen so that in each instance, they are less than the curvatures of the sub-projectile cross sections, even if their radii lie in a relatively large tolerance region.

The profiles or cross sections of the grooves may be embodied by different curves. For manufacturing reasons, generally grooves may be preferred with arcuate profiles so that the grooves include the shape of cylinder sectors.

The grooves may be preferably dimensioned and disposed so that the packing density of the payload is practically optimal, i.e., is as dense as at all possible for columns with equal circular cross sections. Nevertheless, certain deviations of the column measurements from the desired measurement may be permissible. At the same time, the grooves may be dimensioned and disposed so that an angle of rotation of the payload with regard to the payload chamber may be as slight as possible. This may be achieved if the columns of the payload are disposed so that, in cross section, the generating curve of the envelope forms a geometric figure, e.g., a polygon and, preferably, a regular hexagon, and that n grooves may be provided which may be disposed in n/2 groups to each of which two grooves are disposed. The angular interval of each group is 360°/(n/2) and the mutual spacing of the groups is naturally greater than the spacings of the grooves of one group.

Since one and the same projectile can be used to transport various payloads and since in addition, even similar payloads can have slightly divergent dimensions in the axial direction as a result of technical manufacturing tolerances, it is advantageous if the axial fixing device for the payload is fastened to the projectile casing by means of a screw connection. This permits an adaptation of the length of the payload chamber to the length of the payload in accordance with a tolerance compensation. A greater length adaptation of the payload chamber may be achieved if the axial fixing device includes a shoulder protruding into the payload chamber. As already mentioned, the payload is frequently divided into axial columns. The number of columns mentioned above is arbitrary and depends upon, among other things, the properties and purposes of the payload. In addition to this division in the axial direction, the columns may also be divided cross-sectionally with respect to their longitudinal direction, into column sections, and may be comprised of column sections. These column sections, as well as columns of one piece, need not be prismatic or cylindrical.

In a preferred embodiment of the projectile according to the invention, the payload may partially or exclusively include sub-projectiles. As is also possible for other payloads, these may occupy the entire length of a column or may be stacked several sub-projectiles to a column. According to the present invention, the term "sub-projectile" may be understood to mean not only munitions of various kinds, but all kinds of payloads, from which a specific continued flight on a determined flight path is expected after its release.

While the payloads mentioned heretofore were merely intended for release by the projectile at a certain time or at a certain place and the continued flight of the payload was of subordinate significance, an additional demand may be placed on the sub-projectiles to continue their flight individually in a predetermined manner after release by the projectile. Accordingly, stabilization of the sub-projectiles may be required. According to the present invention, primarily longer sub-projectiles may be included within the projectile so that they fly in an at least partially arrow-stabilized manner. Preferably, in each instance, the stabilization is due to spin. The sub-projectile spin, i.e. rotation around themselves, is generated by the projectile according to the invention. In fact, during flight, the columns which make up the payload may be given not only a rotation around the longitudinal projectile axis, but also an individual rotation or spin.

The spin of the sub-projectiles may be preserved during and after the release by the projectile. Otherwise, the sub-projectiles may not continue to fly in a stable manner and, consequently, begin to tumble. As a result of tumbling, the sub-projectile may essentially lose energy and, therefore, reduce the shape options for the sub-projectiles, which are chosen in accordance with a desired angle of departure, i.e. the angle between the flight paths of the projectile and the sub-projectile, and in accordance with the desired spin stabilization of the sub-projectile. So that the required spin of the sub-projectiles may be preserved, it is essential that the sub-projectiles in the region of the dividing wall are not damaged by the detonation or explosion of the opening charge and that the sub-projectile release occurs in a trouble-free manner. This feature is achieved according to the invention since the explosion of the opening charge only exerts indirect or direct forces on the sub-projectiles to a very limited degree.

In particular, if the projectiles or sub-projectiles are embodied as munitions for military purposes, then the dispersion pattern or the sub-projectile distribution realized may be of great importance to the efficiency of the weapon system with which they are associated. In projectiles in which the sub-projectiles are not divided in the axial direction, a sub-projectile distribution may be produced in which equal sub-projectiles are disposed in a circle, equally spaced apart from the projectile axis. The sub-projectiles originally disposed close to the projectile axis reach a circle with the smallest radius, while the sub-projectiles disposed at greater distances from the projectile axis are found in circles which are concentric to and have greater radii than the smaller circle.

In a suitable embodiment of the projectile according to the invention, a greatly improved dispersion pattern may now be achieved according to the explanations below. Sub-projectiles of various types may be installed in the projectiles according to the invention. By taking advantage of the fact that through the action of the detonated opening charge, the payload chamber opens essentially along a casing line similar to a zipper from the bottom to the top. A particularly advantageous dispersion pattern or distribution of the sub-projectiles may be achieved if sub-projectiles are used, particularly when several are stacked flush on top of one another to constitute the payload columns. The opening of the payload chamber begins at the back and continues toward the front. During the opening of the payload chamber, the spin-stabilized projectile rotates around the projectile axis, resulting in the fact that the sub-projectiles of a column are not released at the same time, but that the bottommost sub-projectiles may exit the payload chamber first, whereupon the other sub-projectiles of the same column follow at regular time or angular intervals, until the topmost sub-projectile has left the payload chamber as the last sub-projectile. With the sub-projectile distribution achieved in this manner, sub-projectiles of one column essentially reach an at least approximately circular arc. In contrast to this, sub-projectiles of a column which are released all at the same time hardly spread out at all so that their dispersion pattern is disposed on a very short section of a radial ray and contracts almost to a point. Accordingly, owing to the continuing opening of the payload chamber from the bottom to the top, the probability of a hit is essentially increased without the use of additional sub-projectiles. It should be further noted that the dispersion pattern or the sub-projectile distribution generally depends upon the radial spacing of the projectiles from the longitudinal axis of the projectile. Sub-projectiles of a first column, disposed close to the longitudinal projectile axis, may be found in a section of a circular arc whose radius is smaller than the radius of the circle which may be reached by sub-projectiles of a second column positioned a farther distance from the longitudinal projectile axis.

It has already been mentioned that the projectile according to the invention may include trouble-free release of the payload or the sub-projectiles so that, as a result of the preservation of their spin, the sub-projectiles continue to move in a spin-stabilized manner which may be predetermined. Since the object of spin-stabilizing the sub-projectiles is thus attained, it is possible to provide sub-projectiles of many different embodiments, in particular, the type whose front part has a shape for which the external and/or final ballistic performance is optimal.

A large number of similar, conventional projectiles may be designed so that they exhibit their optimal effect only by sub-projectile hits, i.e. with a release of the sub-projectiles in flight, not by projectile hits, also referred to as direct hits, before the release of the sub-projectiles by the projectile. Alternatively, the projectile according to the invention may be embodied so that a good effect is produced even with a projectile hit. Accordingly, a device may be disposed in the region in front of the sub-projectile chamber, but inside the ballistic cap or ogive, which may, in the event of a direct hit, function as a penetrator or plow. The ballistic cap may advantageously be mounted on the projectile casing so that it has the tendency to push the cover away radially upon impact. This has the favorable effect not only that a penetration into the target object is produced through the action of the penetrator, but also that the sub-projectiles may radially diverge.

In a construction which is particularly optimal because it is weight-saving, the axial fixing device with which the sub-projectiles may be clamped together may include this kind of penetrator or plow.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein:

FIGS. 5A–5E illustrate side views of five exemplary embodiments of columns of sub-projectiles; and FIGS. 6A–6C illustrate detailed side views of three exemplary embodiments of sub-projectiles disposed in a column.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
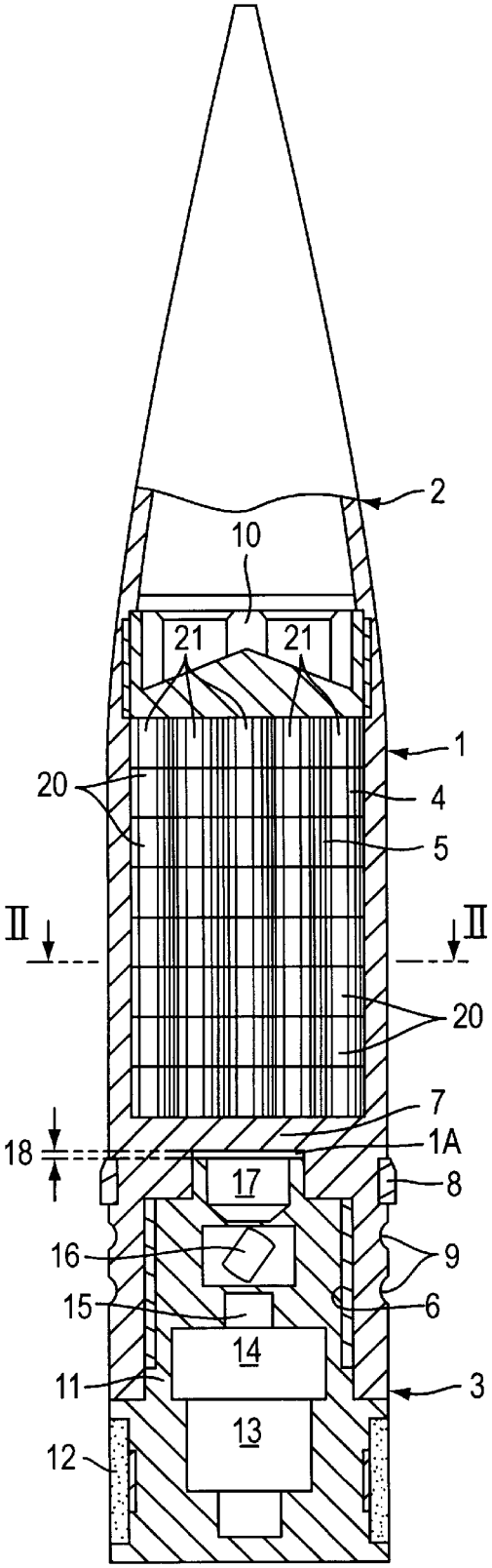
FIG. 1 illustrates a first projectile according to the invention in a longitudinal section.
Figure 7:
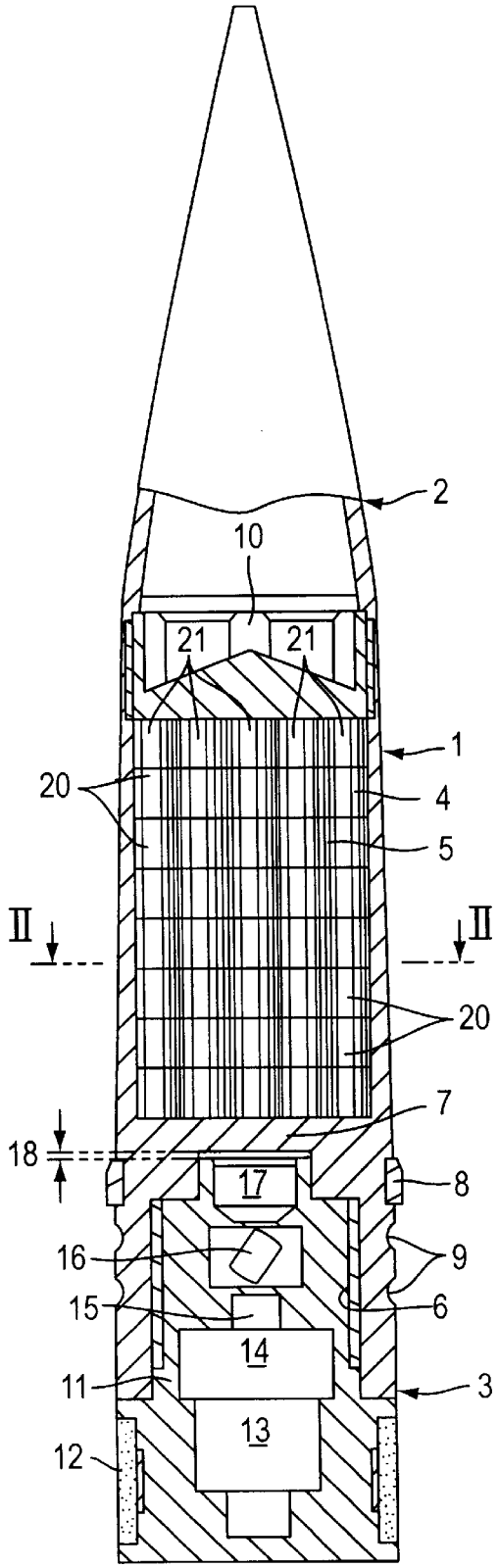
FIG. 7 illustrates a longitudinal section of an alternative projectile according to the present invention.

According to FIG. 1, the projectile which may be spin-stabilized includes a projectile body with a projectile casing 1, preferably made of, e.g., a light metal, a ballistic (or ogive) cap 2, and a fuse 3 which may be fastened to a rear part of projectile casing 1. The fuse may preferably be a programmable time fuse, however, other fuse types, e.g., a remote fuse whose ignition is triggered by transmission means, may also be utilized in accordance with the present invention. The fuse may also be disposed on the front part of the projectile casing. However, this arrangement includes the disadvantage that an ignition conduit may be required to axially run through the projectile casing, which reduces the available space within the projectile casing. The projectile may include a payload chamber 4 for a payload 5 to be fixed therein, and an ignition chamber 6. Payload chamber 4 may be defined by longitudinal walls having a same longitudinal thickness substantially from dividing wall 7 to ballistic cap 2, or, alternatively, may be defined by longitudinal walls that decrease in longitudinal thickness substantially from dividing wall 7 to ballistic cap 2, as shown in FIG. 7. Ignition chamber 6 may be disposed behind payload chamber 4 and partially divided by a bridge-like dividing wall 7. The projectile may also include a guide band 8 and indentations 9 for fastening in a cartridge case (not shown). An axial fixing device which may include a retaining screw 10 keeps the payload 5 fixed in the axial direction and connects the projectile casing 1 to the ballistic or ogive cap 2. Time fuse 3, which may be fastened in the ignition chamber 6, may include an ignition housing 11, a data receiving coil 12, an power supply 13, e.g., with a surge generator, an electronic timed ignition module 14, a fuse 15, a detonator 16, and an opening charge 17 disposed in an explosive chamber.

Figure 4:
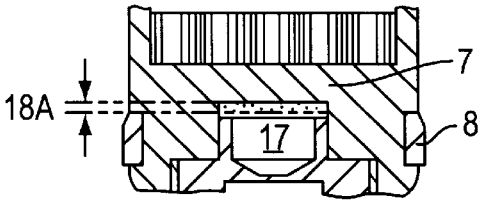
FIG. 4 illustrates a detail from a second projectile according to the invention in order to depict a different damping device.

An explosive charge may provided as opening charge 17, which may be disposed in fuse 15 or time fuse 3, to be in full contact in the radial direction of the projectile. Further, the explosive charge may be disposed in a projectile body part 1A, which may adjoin the projectile casing 1, but which may be axially spaced from bridge-like dividing wall 7. This spacing constitutes a damping device 18. Opening charge 17 may be directly positioned within projectile body part 1A, then the fuse sequence to one of the fuse, time fuse 3, or detonator 16 should be assured. Damping device 18 may include an air gap positioned between the bridge-like dividing wall 7 and the opening charge 17, as shown in FIG. 1. Alternatively, instead of air, the gap may be filled with a material 18A as shown in FIG. 4. Material 18A may be any suitable material that includes predetermined damping properties, e.g., reducing pressure or shock wave propagation.

Figure 2:
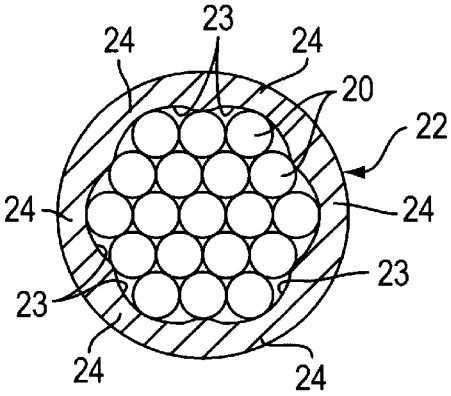
FIG. 2 illustrates the projectile shown in FIG. 1 in a section along the line II—II of FIG. 1.

According to FIGS. 1 and 2, in this exemplary embodiment, payload 5 may include a plurality of cylindrical sub-projectiles 20. Cylindrical sub-projectiles 20 may be made of heavy metal and may be arranged into a plurality of columns 21. Sub-projectiles 20 in each column 21 are coaxially positioned in the payload chamber 4, and each column 21 is arranged parallel to a longitudinal projectile axis. Columns 21 may be positioned so that in cross section, a generating curve of their envelope is a regular hexagon.

As shown in FIGS. 1 and 2, each column of sub-projectiles may include, e.g., eight coaxially arranged sub-projectiles 20. Further, payload chamber 4 may include, e.g., nineteen columns 21 longitudinally disposed parallel to the projectile longitudinal axis and firmly fixed therein by means of the screwed-in axial fixing device 10. It is recognized that the number of projectiles to be positioned within a column and the number of columns to be arranged within the payload chamber depends upon, e.g., the available space within the projectile for payload, the length of the sub-projectile 20, the width of the sub-projectile 20, etc. As will explained hereinbelow, during a projectile hit, the axial fixing device 10 acts as, e.g., a plow or penetrator. In the region of payload chamber 4, projectile casing 1 may include a hollow cylinder 22 with additional recesses or grooves 23 running in the direction of the longitudinal projectile axis.

According to FIG. 2, hollow cylinder 22 may include, e.g., six grooves 23 provided in, e.g., three groups of two grooves. The groups may be divided at an angular interval of, e.g., 360°/n, where n represents the number of groups. Accordingly, when the grooves are divided into, e.g., 3 groups, the groups may be divided at an angular interval of 120° along the circumference of payload chamber 4. Further, the mutual spacing of the groups may be greater than the spacing of the sub-projectiles of one group. Grooves 23 may be recesses in the shape of cylinder sectors disposed eccentrically to the longitudinal projectile axis. These recesses or grooves 23, cooperating with axial fixing device 10, may secure sub-projectiles 20 or columns 21 against movements relative to the projectile casing 1. There may be certain room for play in the radial direction to absorb non-uniformity, e.g., manufacture conditional tolerances of the sub-projectiles, but the relative rotational angle may be maintained at as small an angle as possible. Further, grooves 23 may include intended break zones 24 which may extend in the axial direction at the locations in the projectile casing 1 in which the smallest wall thickness is created.

The function of the spin-stabilizable projectile for producing sub-projectile hits may be described hereinbelow. If fuse 15 is ignited, then the opening of the projectile casing 1 or the payload chamber 4 may be executed via detonator 16 and opening charge 17. Subsequent to the detonation of opening charge 17, payload 5 or the sub-projectiles 20 would emerge relative to the projectile in a tangential direction. Due to the structural construction of the region adjacent opening charge 17, shock (or pressure) waves may be immediately produced by the detonation in the radial direction and may be delayed in the axial direction. Accordingly, starting at the region of guide band 8, projectile casing 1 may be split open and payload chamber 4 may be opened along intended break zones 24. The opening may continue from, e.g., the bottom to the top, in the manner similar to opening a zipper or peeling a banana. The parts of projectile casing 1 released upon splitting open may be accelerated away by the effects of centrifugal force. Because of damping device 18, payload 4 may only be weakly acted upon by the pressure wave. The release of undamaged sub-projectiles 20 occurs in a time-delayed, practically trouble-free manner. Upon release from the projectile, sub-projectiles 20 may continue to fly in an individually spin-stabilized manner at an acute angle of departure.

The arrangement of payload 5 within the projectile greatly improves a dispersion pattern of the payload upon release. The present invention takes advantage of the fact that through the action of the detonated opening charge, the payload chamber opens essentially along a casing line similar to a zipper from the bottom to the top. A particularly advantageous dispersion pattern or distribution of the sub-projectiles 20 may be achieved if sub-projectiles are used, particularly when several are stacked flush on top of one another to constitute the payload columns. The opening of the payload chamber 4 begins at the bottom (bridge 7) and continues toward the top (cap 2). During the opening of the payload chamber 4, the spin-stabilized projectiles 20 rotate around the projectile axis, resulting in the fact that the sub-projectiles 20 of a column 21 are not released at the same time, but that the bottommost sub-projectiles may exit the payload chamber first, whereupon the other sub-projectiles of the same column follow at regular time or angular intervals, until the topmost sub-projectile has left the payload chamber 4 as the last sub-projectile. With the sub-projectile distribution achieved in this manner, sub-projectiles of one column essentially reach an at least approximately circular arc, as shown in FIG. 3.

Accordingly, owing to the continuing opening of the payload chamber 4 from the bottom to the top, the probability of a hit is essentially increased without the use of additional sub-projectiles. It should be further noted that the dispersion pattern or the sub-projectile distribution generally depends upon the radial spacing of the projectiles from the longitudinal axis of the projectile. Sub-projectiles of a first column, disposed close to the longitudinal projectile axis, may be found in a section of a circular arc whose radius is smaller than the radius of the circle which may be reached by sub-projectiles of a second column positioned a farther distance from the longitudinal projectile axis.

Figure 3:
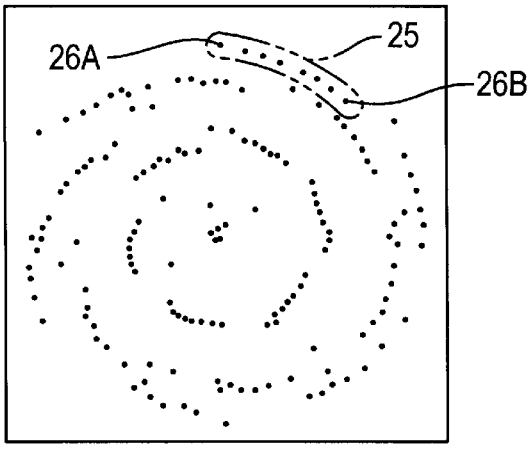
FIG. 3 illustrates a diagram of a dispersion pattern or sub-projectile distribution produced by the sub-projectiles of the projectile shown in FIG. 1.

The result of the arranging sub-projectiles 20 into, e.g., nineteen coaxial columns 21 with respectively different spacings from the longitudinal projectile axis and of the trouble-free, "stage-wise" or cyclical release of the sub-projectiles 20 should be apparent from the sub-projectile distribution or scattering of a projectile of this type, which includes one hundred fifty two sub-projectiles 20, as is shown in FIG. 3. For example, the group of points within circle 25 may be traced back to sub-projectiles 20 from a first (outer) column having the greatest spacing from the longitudinal projectile axis, i.e. resting against the projectile casing. Point 26A corresponds to the bottommost sub-projectile of the first column and point 26B corresponds to the topmost sub-projectile of the first column.

In lieu of the sub-projectile hit described, a projectile hit, also called a direct hit, may occur in cases in which, either voluntarily or involuntarily, no ignition has occurred prior to impact of the projectile with a target object. In this instance, axial fixing device 10 acting as a penetrator, enables a good final ballistic performance to be obtained in these cases as well.

FIGS. 5A–5E show sub-projectiles 20A–20E according to various embodiments of the present invention. While only one column 21A–21E of each is shown, it is recognized that more than one column may be utilized, as discussed above. FIG. 5A shows a plurality of sub-projectiles 20A, which are similar to the above-described sub-projectiles 20, i.e., cylindrical and disposed coaxially together to form column 21A. FIG. 5B comprises a column 21B with very short, practically disk-shaped sub-projectiles 20B, which permit a very favorable spin stabilization. FIG. 5C shows a long sub-projectile 20C, which may include the entire column 21C. In the exemplary embodiment shown, it is a sub-projectile which may be partially arrow-stabilized. FIG. 5D shows a plurality of sub-projectiles 20D, which likewise may be partially arrow-stabilized. In this example, two sub-projectiles correspond to the entire length of column 21D, however, any number may be employed by the ordinarily skilled artisan. FIG. 5E shows sub-projectiles 20E, which are spherical or ball-shaped.

FIGS. 6A–6C show three examples of sub-projectiles 20F, 20G, 20H, which may be dimensionally similar to sub-projectiles 20A shown in FIG. 5A, but may have top and bottom surfaces shaped for arranging the columns. As shown in FIG. 6A, sub-projectile 20F includes a planar top and bottom surface for evenly arranging columns. In FIG. 6B, the sub-projectile may include a conical shape 20GT on the top of sub-projectile 20G. A complementary conical indentation 20GB may be disposed on the bottom of sub-projectile 20G for receiving at least a portion of the conical shape on top of a lower arranged sub-projectile 20G'. Accordingly, the sub-projectiles may be arranged in columns by successively positioning sub-projectiles, as shown in FIG. 6B. In FIG. 6C, the sub-projectile may include a spherical shape 20HT on the top of sub-projectile 20H. A complementary conical indentation 20HB may be disposed on the bottom of sub-projectile 20H for receiving at least a portion of the conical shape on top of a lower arranged sub-projectile 20H'. Accordingly, the sub-projectiles may be arranged in columns by successively positioning sub-projectiles, as shown in FIG. 6C.

While the illustrations show the payload as at least one sub-projectile, other types of payload may be utilized for weaponry purposes, e.g., CHAFF or FLARE payloads may be utilized to produce false targets or to screen a flying target. Further, sub-projectiles of various types and with various employment purposes may be accommodated within a single projectile. Projectile payload may also be utilized for non-weapon applications, e.g., meteorology, etc.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A spin-stabilized projectile for delivering a payload, comprising:

an elongated casing having a longitudinal axis, said longitudinal axis extending from a top portion of said elongated casing to a bottom portion of said elongated casing;

a payload chamber disposed within said elongated casing having a chamber top and a chamber bottom;

said payload chamber comprising an inner surface substantially parallel to said longitudinal axis and having a number of arcuate grooves, wherein a curvature of said arcuate grooves is smaller than a curvature of a cross-section of a cylindrical column of said payload;

a dividing wall disposed between said bottom portion of said elongated casing and said chamber bottom;

an opening charge positioned within a recess formed in said dividing wall and coupled to a detonation device for detonating said opening charge, said dividing wall transmitting a radial force generated by a detonation of said opening charge;

a suppression space for suppressing axial force generated by said detonation of said opening charge, said suppression space positioned between said opening charge and said recess;

said payload comprising a plurality of cylindrical columns positioned so that a generating curve of their envelope forms a polygon, said polygon having a number of sides equal to the number of arcuate grooves of said payload chamber;

said arcuate grooves being provided in a number of groups equal to one-half of said number of arcuate grooves with angular intervals of 360°/number of groups, wherein a mutual spacing of groups is greater than a spacing of arcuate grooves within said group.

* * * * *